United States Patent [19]

Spadaccini

[11] 4,226,087

[45] Oct. 7, 1980

[54] FLAMEHOLDER FOR GAS TURBINE ENGINE

[75] Inventor: Louis J. Spadaccini, Manchester, Conn.

[73] Assignee: United Technologies Corporation, Hartford, Conn.

[21] Appl. No.: 16,759

[22] Filed: Mar. 1, 1979

[51] Int. Cl.[3] ..... F02C 7/22

[52] U.S. Cl. ..... 60/749; 60/737; 431/350

[58] Field of Search ..... 431/350, 347; 60/749, 60/737, 738

[56] References Cited

U.S. PATENT DOCUMENTS

| | | | |
|---|---|---|---|
| 3,061,001 | 10/1962 | Reed | 431/346 X |
| 3,739,576 | 6/1973 | Chamberlain | 60/738 |
| 4,067,190 | 1/1978 | Hamm et al. | 431/346 X |

*Primary Examiner*—Carlton R. Croyle
*Assistant Examiner*—Edward Look
*Attorney, Agent, or Firm*—Norman Friedland

[57] ABSTRACT

A flameholder of a burner for a gas turbine engine includes a discrete pattern of judiciously shaped apertures having projectiles in the form of cusps formed on the upstream face facing the airstream so as to improve the flameholder with a consequential reduction in the concentration level of gaseous pollutants.

2 Claims, 4 Drawing Figures

FIG. 3
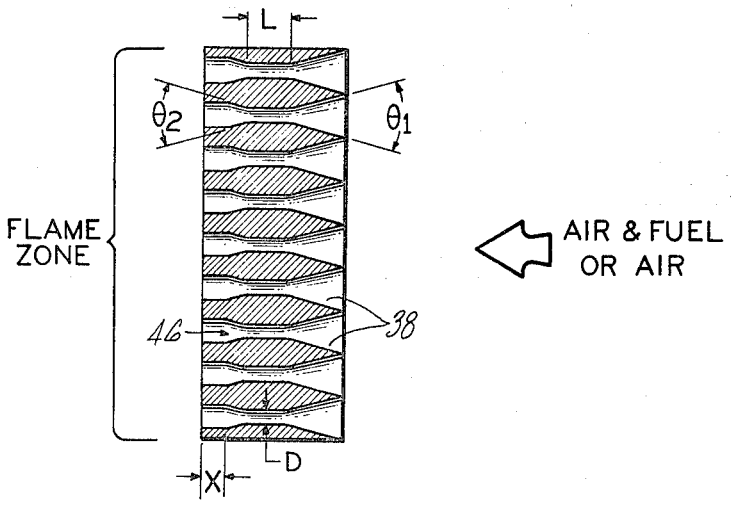
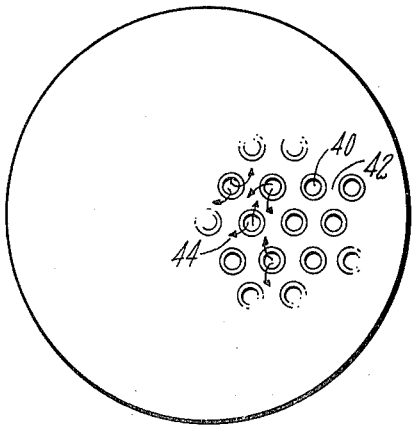
FIG. 4

FLAMEHOLDER FOR GAS TURBINE ENGINE

BACKGROUND OF THE INVENTION

This invention relates to gas turbine engines and particularly to the flameholder of its burner.

To be compatible with ecological considerations, a great effort is being manifested to reduce the pollutants emitted in the atmosphere from gas turbine engines, particularly of the type powering aircraft. One of the areas of concern has been the engine's burners. Although, these combustors are highly efficient, the combustion process can be modified to change the burning characteristics and hence improve the emission of the pollutants by reducing, for example, the $NO_x$ content without imparing combustor efficiency. U.S. patent applications Ser. Nos. 712,575 and 515,789 now U.S. Pat. No. 4,179,881 filed by Marshall et al and Faucher et al respectively, and assigned to the same assignee for example, disclose means for reducing pollutants by premixing the air and fuel prior to admission in the combustor. In these applications the flameholder is a baffle plate with a plurality of apertures that produce localized eddies, defining a stagnation zone for stabilizing combustion. Essentially, what is needed to achieve a reduction in the pollutant levels while achieving a high combustion performance is (1) generate a uniformly lean fuel air mixture prior to combustion and (2) provide a primary combustion zone having a uniform temperature and low species residence time.

This invention is somewhat akin to the teachings in the above-mentioned patent application, but is concerned primarily with the design of the flameholder. To achieve the requirements noted immediately above this invention is for a flameholder that affords the following advantages:

(1) good lean fuel-air ratio stability characteristics, (2) low flashback potential, and (3) low pressure loss characteristics.

SUMMARY OF THE INVENTION

A feature of this invention is to provide for a gas turbine type power plant an improved combustor that lessens pollutant emissions without deteriorating combustion efficiency. A feature is to provide a flameholder that is designed to include discretely shaped convergent-divergent multiple nozzles. Projectiles, in the form of cusps extend in the engine working fluid stream have extended surfaces exposed to the airstream improving heat removal of the flameholder. The cusps also serve to preclude the formation of recirculation zones and/or stagnation points in the converging section of the flameholder. Recesses on the downstream facing side contain recirculating combustion products and serve to increase heat recirculation. Owing to a plurality of circular holes of uniform size separated by relatively narrow web, a thin, uniform flame attaches to the downstream face of the flameholder.

Other features and advantages will be apparent from the specification and claims and from the accompanying drawings which illustrate an embodiment of the invention.

BRIEF DESCRIPTION OF THE DRAWINGS

FIG. 3 is a view in section illustrating the shape of the individual nozzles; and, FIG. 4 is an end view of FIG. 3 showing the flame zone of the flameholder.

DESCRIPTION OF THE PREFERRED EMBODIMENT

Figure 1:
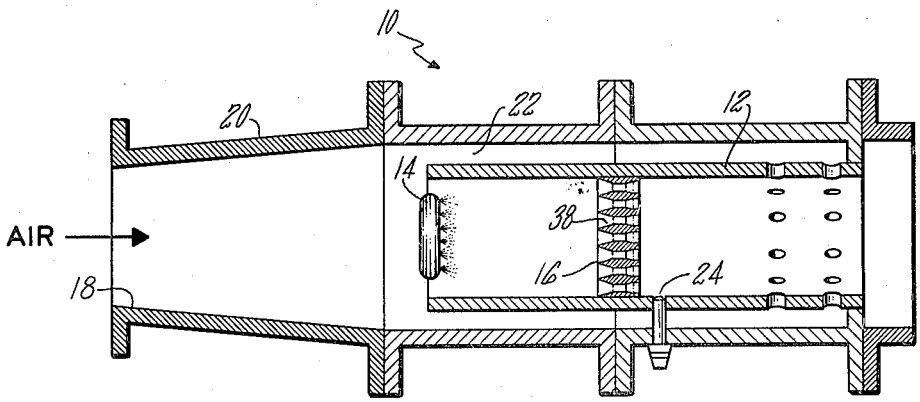
FIG. 1 is a schematic view partly in section of a combustor utilizing this invention in an actual test fixture.

The flameholder of the combustor of a jet engine serves to stabilize the flame and sustain combustion without continuous ignition. As illustrated in the preferred embodiment of this invention the combustor assembly, generally indicated by numeral 10 is shown in a test fixture that comprises the combustor 12, fuel nozzles 14 and flameholder 16. Air is admitted at the inlet 18 of the cylindrical casing 20 and a portion thereof enters the combustor 12 where it mixes with the fuel before being admitted to flameholder 16 and a portion of the air flows around the outer periphery in annular passageway 22. Igniter 24 serves to initially ignite the fuel/air mixture to initiate combustion. Proper recirculation, that is localized eddies generated by the flameholder serve to stabilize the flame immediately downstream of the flameholder. As will be obvious to one skilled in this art, the combustor can be fabricated into a well known annular type rather than the can type and employ this invention.

Figure 2:
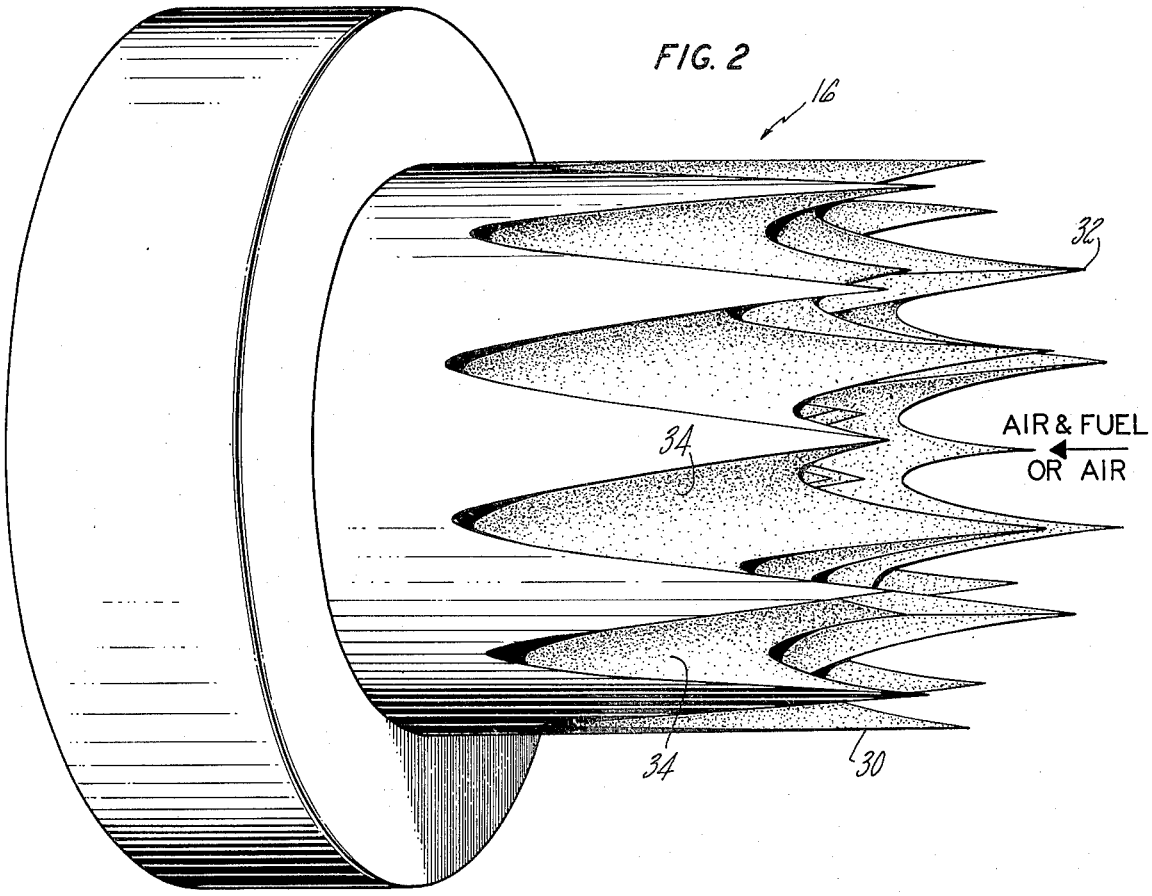
FIG. 2 is a perspective view of a test model of this invention.

As can be seen from FIG. 2, the forwardly facing projectiles 30, that is the apexes 32 point in the direction of where the flow came from. Apexes 32 first come into contact with the fuel/air mixture and the surface 34 is extended in forms of cusps which effectively remove heat from the flameholder. In addition the projectiles serve to preclude the formation of recirculation zones and/or stagnation points in the converging section 38. Obviously, for burner effectiveness it is necessary to confine the flame at the indicated flame zone.

The flameholder 16 comprises a plurality of closely spaced uniformly sized holes 40 separated by relatively narrow webs 42, (that portion of material between each hole). The holes are sized and located to minimize pressure loss and produce a thin, uniform flame in the flame zone. The size and location of holes serves to produce localized eddies, indicated by the circular arrows 44 in FIG. 4, creating the stagnation zones necessary to stabilize the flame. According to this invention, the angle $\theta_1$ is greater than 0° and equal to or less than 20°, the angle $\theta_2$ is between 30° and 180°, L is between $\frac{1}{2}$D and 5D and x is equal to or less than 5D. As noted in FIG. 3, $\theta_1$, is the convergent angle, $\theta_2$ is the divergent angle, L is the length of the throat, D is the diameter of the throat and x is the length of the extension of the circular section extending from the divergent section adjacent the flame zone of the flameholder.

Each passageway 46 in the flameholder is formed in a convergent-divergent nozzle to achieve a low flashback potential and low pressure loss characteristics.

Actual tests have shown that significant redirections in the concentration levels of gaseous pollutants emitted from gas turbine engines can be achieved by the careful regulation of the temperature and the residence time of the reacting gases in the flame zone owing to the specific flameholder taught by this disclosure.

The use of the perforated-plate containing an array of uniformly sized holes creates recirculation zones capable of stabilizing combustion of a lean, premixed and prevaporized fuel air mixture. The technique of varying the internal diameter of the perforations reduces flow disturbances and pressure loss, and improves stability. Superior heat transfer and flow characteristics are achieved by the cusped-type design.

It should be understood that the invention is not limited to the particular embodiments shown and described herein, but that various changes and modifications may be made without departing from the spirit and scope of this novel concept as defined by the following claims.

I claim:

1. A flameholder for a burner for a gas turbine engine where the burner receives air from an airstream, said flameholder comprising a block-like element extending transverse to the airstream in proximity to where combustion ensues, a plurality of spaced axially extending apertures formed in said block-like element for passing air from said airstream therethrough, the diameters of said apertures are varied to form in each a converging section on the upstream end, a circular section on the downstream end, an adjacent diverging section and a throat section intermediate the converging and diverging sections relative to the airstream, cusps surrounding said apertures extending in a direction facing said airstream so that the apex thereof contacts said airstream first for precluding the formation of stagnation points in said diffuser section, said cusps having extending surfaces for removing heat from said block-like element, the downstream facing surface of said plate-like element being substantially planar and the circular sections of said apertures terminating therein for defining a web-like pattern wherein the discharging flow forms localized eddies for defining relatively small recirculating zones for stabilizing the flame formed adjacent thereto.

2. A flameholder as claimed in claim 1 wherein the angle of said converging section is greater than 0° and no larger than 20°, the angle of the diverging section is between 30° and 180° and the length of the throat section is between $\frac{1}{2}$ and 5 times the diameter of said throat section.

* * * * *